United States Patent [19]

Hälssig et al.

[11] Patent Number: 4,790,246

[45] Date of Patent: Dec. 13, 1988

[54] FUSE

[75] Inventors: Andreas Hälssig, Denkingen; Horst Moosmann, Schramberg; Horst Dinger, Tennenbronn, all of Fed. Rep. of Germany

[73] Assignee: Gebruder Junghans GmbH, Schramberg, Fed. Rep. of Germany

[21] Appl. No.: 103,496

[22] Filed: Oct. 1, 1987

[30] Foreign Application Priority Data

Oct. 15, 1986 [DE] Fed. Rep. of Germany ..... 3635084

[51] Int. Cl.[4] ..... F42C 15/00; F42C 15/34

[52] U.S. Cl. ..... 102/254; 102/222; 102/258

[58] Field of Search ..... 102/222, 254, 258

[56] References Cited

U.S. PATENT DOCUMENTS 3,763,785 10/1973 Briggs et al. ..... 102/258
3,973,501 8/1976 Briggs ..... 102/224
4,144,816 3/1979 Beuchat ..... 102/254
4,464,991 8/1984 Kaiser ..... 102/255

FOREIGN PATENT DOCUMENTS 8119466 9/1982 Fed. Rep. of Germany .

*Primary Examiner*—David H. Brown
*Attorney, Agent, or Firm*—Burns, Doane, Swecker & Mathis

[57] ABSTRACT

A fuse is capable of installation in a warhead only when a rotor of the fuse is in its safety position. If the rotor is in its live position, installation in the fuse is not possible. The fuse comprises an installation safety element which is movable between a normal first position blocking installation of the fuse and a second position permitting such installation. In its live position, the rotor blocks movement of the element to its second position. When in its second position, the element does not interfere with movement of the rotor to a live position.

7 Claims, 2 Drawing Sheets

FIG. 3
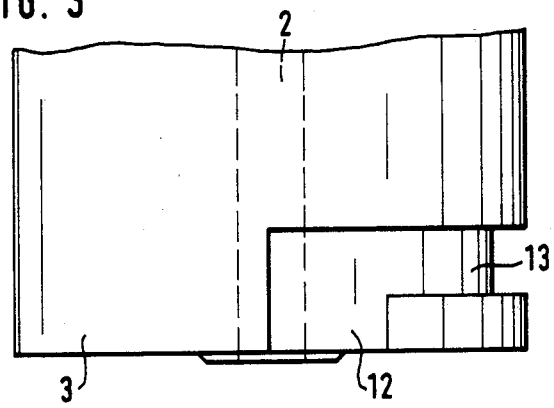
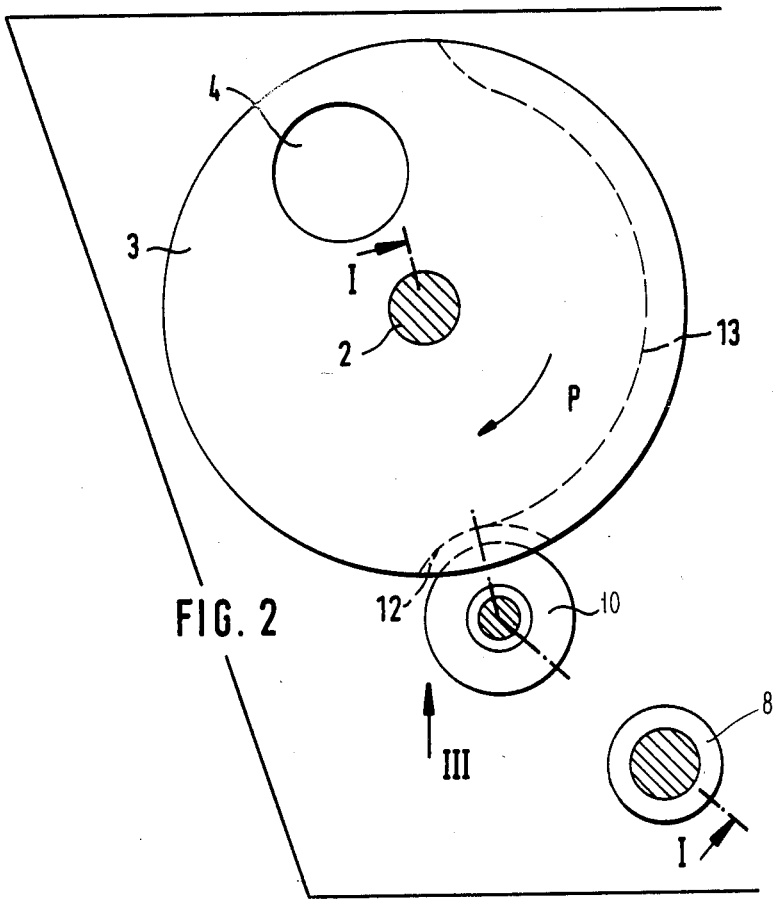
FIG. 2

FUSE

BACKGROUND AND OBJECTS OF THE INVENTION

The invention concerns a fuse equipped with a rotor, which upon release from a safety position travels to a live position, and which may be installed in a warhead which includes any suitable kind of projectile or ammunition.

A fuse of that type which is described, for example in German Application GM No. 81 19 466.8, is to be installed into a warhead. Despite strict safeguards, it cannot be absolutely guaranteed that the rotor will not have traveled into its live position prior to installation of the fuse into the warhead. Such an occurrence would present a serious hazard.

It is an object of the invention to exclude the possibility of installing the fuse if the rotor is already in its live position. However, such measures must not prevent the rotor from traveling to its live position, after installation.

SUMMARY OF THE INVENTION

The above object is attained according to the invention wherein a fuse comprises an installation safety element, which into one position (locking position) blocks installation of the fuse in a warhead and which in its other position (installation position) permits such installation. The rotor, when in its live position, blocks the installation safety element against movement to the installation position of the latter. In its safety position the rotor releases the installation safety element for movement of the latter into its installation position. When the installation safety element is in its installation position, it enables the rotor to move to the live position.

This insures that a fuse with its rotor in the live position cannot be installed in a warhead. Only when the rotor is in its safety position may the fuse be installed in the warhead. Thereafter, the fuse may travel to its live position.

It is further possible to ascertain even before the attempted installation of the fuse whether the rotor is in the safety position by actuating the installation safety element manually. If it is blocked, the rotor must be set into its safety position to attempt an installation.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 2 is a section taken along the line II—II in FIG. 1; and

FIG. 3 is a view of the rotor taken in the direction of the arrow III in FIG. 2.

DETAILED DESCRIPTION OF A PREFERRED EMBODIMENT OF THE INVENTION

Figure 1:
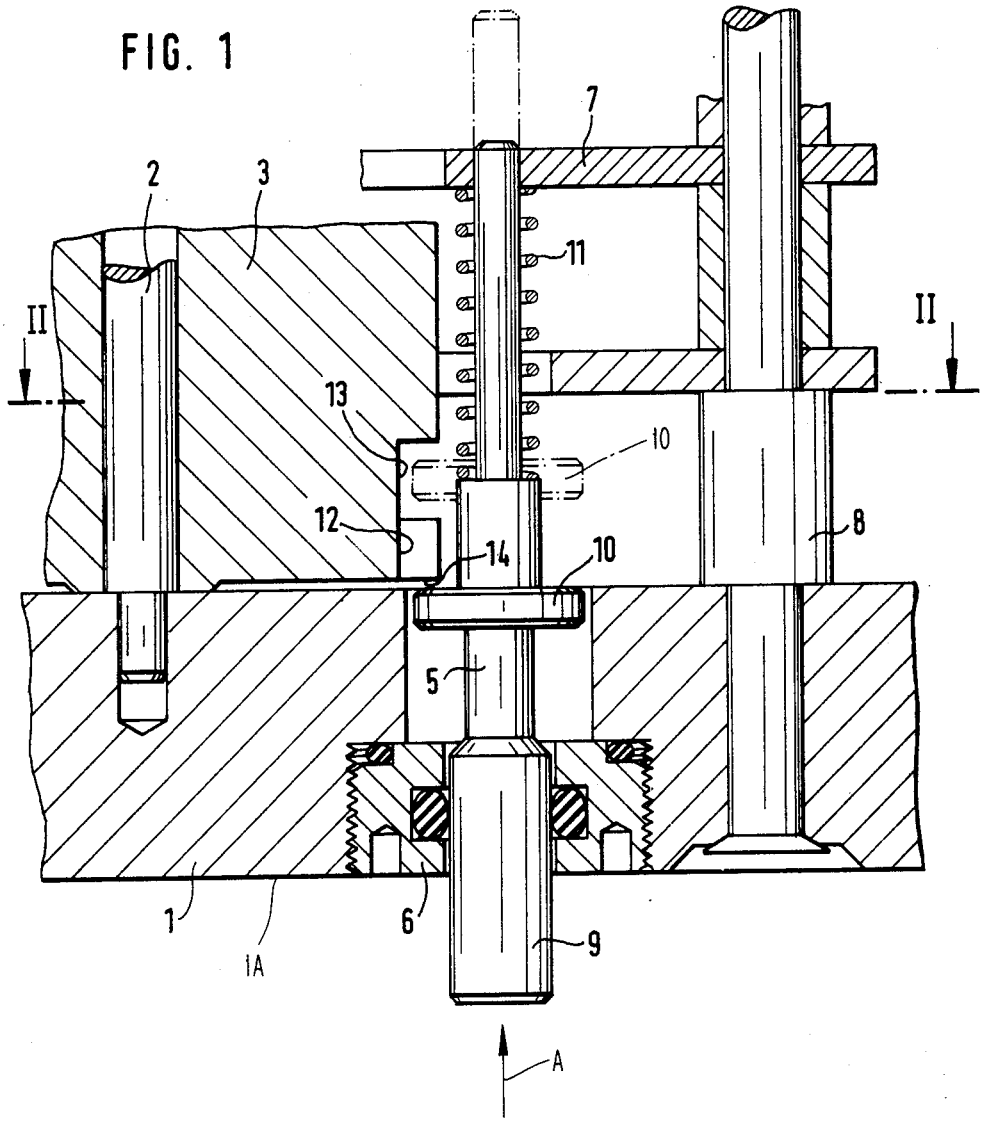
FIG. 1 is a partial section through a fuse along the line I—I of FIG. 2, the rotor being in a safety position and not installed in a warhead.

A fuse comprises a support bottom 1. A rotor 3 capable of turning about an axle 2 rests on that bottom 1. The rotor 3 has a bore 4 (FIG. 2) located out of alignment with an ignition mechanism (not shown) in the safety position of the rotor 3 shown in FIG. 2. The rotor 3 is held in its safety position by suitable conventional safety means (not shown). Upon the release of that safety means, the rotor 3 pivots in the direction of the arrow P (FIG. 2), until the bore 4 is aligned with the ignition mechanism.

In accordance with the present invention, an installation safety mechanism is provided which prevents the fuse from being installed in a warhead if the fuse is in a live position. That mechanism includes an installation safety element 5 in the form of a pin mounted on the support bottom 1. One side of the installation safety element 5 is slidably guided in a bushing 6 which is screwed into the support bottom 1. The other side of the element is guided in a support plate 7 which is connected by a bolt 8 to the support bottom 1.

The installation safety element 5, which is displaceable parallel to the axle 2, comprises a locking projection 9 and a collar 10. A compression spring 11 yieldably biases the installation safety element in such manner that its locking projection 9 extends beyond the support bottom 1 (FIG. 1).

Provided on the outer circumference of the rotor 3 is a recess shaped as a sector of a circle. That recess is contiguous with an annular groove 13 extending along the circumference of the rotor 3. The recess 12 and the annular groove 13 of the rotor 3 on the one hand, and the collar 10 of the installation safety element 5 on the other hand, form a coupling between the rotor and the installation safety element.

Prior to installation of the fuse, the collar 10 is located behind the recess 12. When the rotor 3 is in the safety position, its recess 12 is aligned with the collar 10. Both conditions are depicted in solid lines in FIG. 1.

If the fuse is to be installed in a warhead, a mounting surface 1A of the bottom 1 is set on a corresponding surface of the warhead, whereby the pin 9 will engage that surface and be urged forwardly in the direction of the arrow A. If the rotor 3 is in its safety position, the installation safety element 5 will be displaced forwardly against the force of the spring 11 whereby the collar 10 will pass through and beyond the recess 12, coming to rest ahead of the recess as depicted in phantom lines in FIG. 1. The locking projection 9 thus does not interfere with the installation of the fuse. Furthermore, with the collar 10 located forwardly of the recess at the height of the annular groove 13, the collar 10 will not prevent rotation of the rotor if the rotor 3 is later released from its safety position; hence, the rotor may pivot into the live position.

If the rotor 3 is out of its safety position when the fuse is to be installed, the locking projection 9 is not able to slide forwardly when the support bottom 1 is set on the corresponding surface of the warhead, because the collar 10 is no longer aligned with the recess 12 and will abut the edge 14 of the rotor. The collar 10 and the edge 14 thus define interengageable stops for preventing movement of the safety element to a position permitting installation of the fuse. Installation of the fuse is thus prevented.

As used herein, the term warhead includes any type of ammunition in which a fuse of the presently disclosed type can be utilized.

Although the present invention has been described in connection with a preferred embodiment thereof, it will be appreciated by those skilled in the art that additions, substitutions, modifications and deletions not specifically described may be made without departing from the spirit and scope of the invention as defined in the appended claims.

What we claim is:

1. In a fuse of the type comprising a rotor mechanism which is movable from a safety position to a live position, said fuse comprising an installation safety means movable between a first position for preventing installation of the fuse into a warhead and a second position permitting such installation, said installation safety means normally disposed in said first position, said rotor mechanism including means preventing movement of said installation safety means to said second position when said rotor mechanism is in said live position and for permitting movement of said installation safety means to said second position only when said rotor mechanism is in said safety position, said installation safety means configured such that no portion thereof is disposed to prevent movement of said rotor mechanism to its live position after the fuse has been installed.

2. A fuse according to claim 1, wherein said fuse comprises stop means oriented to prevent movement of said installation safety element to said second position when said rotor is out of said safety position.

3. A fuse according to claim 2, wherein said stop means comprises interengageable portions of said rotor and safety means.

4. A fuse according to claim 1, wherein said installation safety means comprises a pin normally projecting beyond a mounting surface of said fuse in said first position, said pin being movable to said second position in a direction parallel to an axis of rotation of said rotor.

5. A fuse according to claim 4 including spring means yieldably urging said pin toward said first position.

6. A fuse according to claim 1, wherein said rotor comprises a recess shaped as a sector of a circle, said installation safety means including a collar, said recess being aligned with said collar when said rotor is in said safety position and sized to permit passage of said collar to enable said installation safety means to travel to said second position.

7. A fuse according to claim 6, wherein said rotor includes an annular groove arranged to receive said collar when said installation safety means is in said second position, to enable said rotor to rotate to said live position.

* * * * *